US006348097B1

(12) United States Patent
Garrett

(10) Patent No.: US 6,348,097 B1
(45) Date of Patent: Feb. 19, 2002

(54) GLUE WHEEL

(76) Inventor: Jimmy R. Garrett, 8339 Renken Rd., Worden, IL (US) 62097

( * ) Notice: Subject to any disclaimer, the term of this patent is extended or adjusted under 35 U.S.C. 154(b) by 0 days.

(21) Appl. No.: 09/358,677

(22) Filed: Jul. 22, 1999

(51) Int. Cl.[7] ..... B05C 1/06; B05C 1/08

(52) U.S. Cl. ..... 118/258; 118/259; 118/261; 156/578

(58) Field of Search ..... 118/259–261, 204, 118/212, 211, 227, 226, 258, 262; 156/578; 74/434; 492/537, 30, 33–37, 17, 24

(56) References Cited

U.S. PATENT DOCUMENTS

| | | | | |
|---|---|---|---|---|
| 2,172,326 A | | 9/1939 | Wittich | 91/68 |
| 2,245,513 A | | 6/1941 | Weicker | 91/51 |
| 2,271,999 A | | 3/1942 | Gariepy | 68/203 |
| 3,340,849 A | | 9/1967 | Adams et al. | 118/246 |
| 3,645,784 A | | 2/1972 | Helgeland et al. | 117/215 |
| 5,194,116 A | | 3/1993 | Davis et al. | 156/578 |
| 5,352,322 A | | 10/1994 | Leverick | 156/578 |
| 5,443,683 A | | 8/1995 | Garrett | 156/578 |
| 5,597,618 A | | 1/1997 | Bayer, Jr. et al. | 427/207.1 |
| 5,720,850 A | | 2/1998 | Otten | 156/578 |
| 5,987,748 A | * | 7/1998 | Calloway | 29/895.21 |

* cited by examiner

*Primary Examiner*—Richard Crispino
*Assistant Examiner*—Kevin P. Shortsle
(74) *Attorney, Agent, or Firm*—Grace J. Fishel

(57) ABSTRACT

A glue wheel for use with a glue shoe in applying a pattern of cold glue to a receiving surface such as a glue flap. The glue wheel has a rim with recessed, glue-holding, structures flanked by smooth side sections for sealing engagement with the glue shoe. There are a pair of circumferential grooves through the glue-holding structures adjacent the smooth side sections and the cold glue is metered by the glue shoe over the glue-holding structures.

5 Claims, 2 Drawing Sheets

GLUE WHEEL

BACKGROUND OF THE INVENTION

1. Field of the Invention

The present invention relates to a glue wheel for use with a glue shoe in applying a pattern of cold glue to a glue flap or the like.

2. Brief Description of the Prior Art

In the manufacture of a cardboard or paperboard shipping container, glue is applied to a tab called a glue flap that projects from one of the outside panels of a box blank. After the glue is applied, the two outside panels are folded onto two inside panels to convert the box blank into a collapsed flat folded form. This operation is performed, usually at high speeds, in a folder-gluer machine. The flat folded form may thereafter be shipped to a customer for erection and filling with product to be shipped therein.

To create a strong container, the glue must be applied to the glue flap uniformly and in an effective amount. A glue unit with a glue shoe having an adjustable metering plate and a glue wheel as described in U.S. Pat. No. 5,443,683 to Garrett can be used to apply a uniform, controlled amount of glue to a glue flap.

The glue wheels described in U.S. Pat. No. 5,443,683 have a rim and an axis of rotation about a shaft. A plurality of grooves or the like are spaced, preferably uniformly, about the central portion of the rim and running transverse the axis of rotation of the glue wheel. The grooves are designed to accept a definite amount of glue for delivery of the glue in a predetermined pattern on the glue flap. The grooves are flanked with smooth side sections for sealing engagement with complementarily curved side walls of the glue shoe when the side walls of the glue shoe are spaced about 0.001 inch from the smooth side sections of the glue wheel. A metering plate is provided in the glue shoe that is movable towards and away from the glue shoe so that the bottom of the plate is between about 0.001 to about 0.016 inch from the wheel. The thickness of the glue applied by the glue wheel is controlled by the distance the plate is raised above the grooves in the glue shoe.

The glue typically used in a folder-gluer is a cold glue and is air dried. Cold glues have been reformulated to meet air quality standards and volatile organic compounds have been removed making them more difficult to handle. When the grooves are machined in the glue wheel described in U.S. Pat. No. 5,443,683, the crests between the grooves are wider along the smooth side sections. With cold glues presently available, a bead of dried glue tends to form along the smooth side sections as the glue is metered in a thin layer over the widened crests. Sometimes these beads flip off, ruining the piece that is being glued. In addition, because of the close tolerances between the glue shoe, metering plate and glue wheel in the glue unit described in U.S. Pat. No. 5,443,683, there is considerable drag on the glue wheel. It is also necessary that an operator have good mechanical skill in positioning the metering plate to obtain a desired glue pattern, a skill that a production worker may not have.

BRIEF SUMMARY OF THE INVENTION

In view of the above, it is an object of the present invention to provide an improved glue wheel that minimizes the formation of a dried glue bead along the side edges of the wheel. It is another object to provide a glue wheel on which the glue shoe creates less drag. It is also an object to provide a glue wheel that makes it easier to set a glue pattern. Other objects and features of the invention will be in part apparent and in part pointed out hereinafter.

In accordance with the invention, a glue wheel for applying a glue pattern of cold glue to a receiving surface such as a glue flap has a hub with a central axis. The hub is adapted for rotation about the axis and has a rim with a plurality of spaced structures recessed in the rim that project outwardly. These recessed structures are flanked by smooth side sections for sealing engagement with a glue shoe. A circumferential groove passes through the recessed structures adjacent the smooth side sections.

In use, the glue is metered between and on the recessed structures by a glue wheel for application to a receiving surface in a desired glue pattern. The circumferential grooves substantially prevent the formation of a bead of dried glue on the recessed structures along the smooth side sections.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which one of various possible embodiments of the invention is illustrated, corresponding reference characters refer to corresponding parts throughout the several views of the drawings in which.

DETAILED DESCRIPTION OF THE INVENTION

Figure 1:
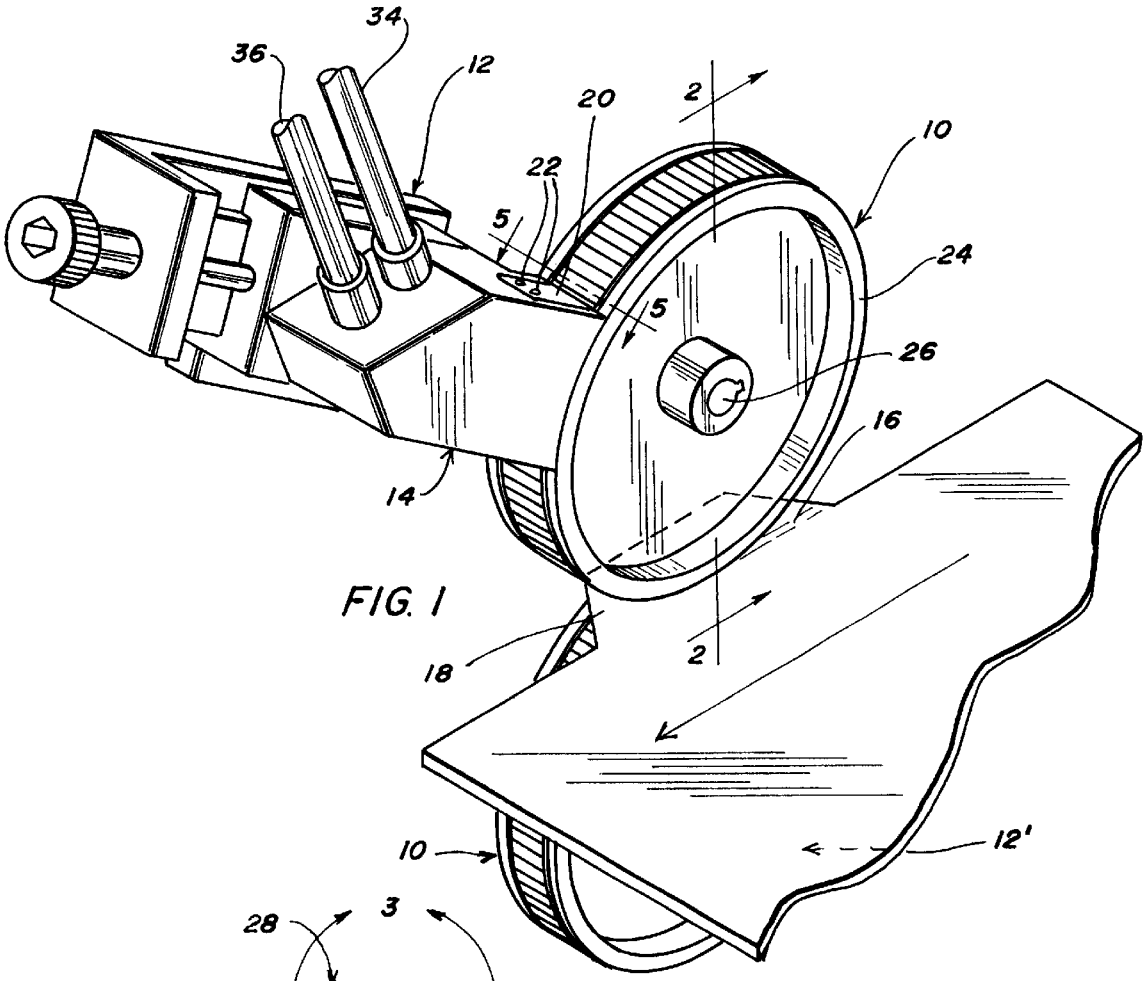
FIG. 1 is a perspective view of a glue unit including a pair of glue wheels in accordance with the present invention.
Figure 2:
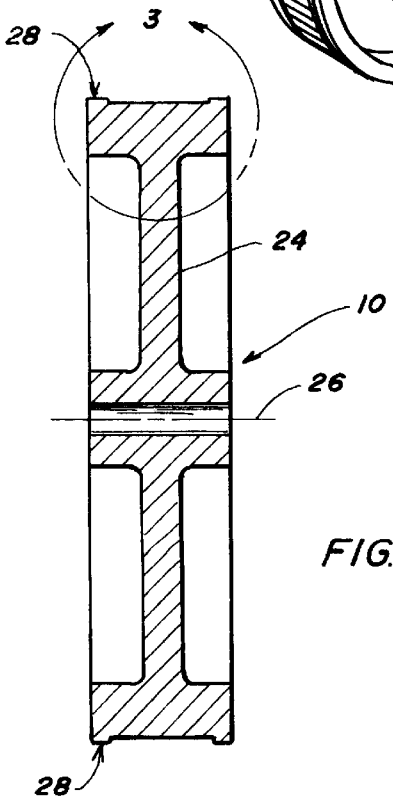
FIG. 2 is a cross-section of a glue wheel taken along line 2—2 in FIG. 1.

Referring to the drawings more particularly by reference character, reference numeral 10 refers to a glue wheel for use in applying cold glue in accordance with the present invention. Glue wheel 10 is adapted for use in a glue unit 12 including a glue shoe 14. As shown in FIG. 1, upper and lower glue units 12, 12', respectively, may be provided for applying a glue pattern 16 to an upper or lower face of a receiving surface 18 such as a glue flap, while the opposite glue wheel serves as a backup roller. Glue shoe 14 is more particularly described in U.S. Pat. No. 5,443,683, which disclosure is incorporated by reference herein. As shown in FIG. 1, glue shoe 14 has a metering plate 20 which can be moved towards and away from glue wheel 10 with bolts 22 locking the metering plate in a selected position. While glue wheel 10 is adapted for use with the particular glue shoe shown in FIG. 1, it will be apparent that it may be used or adapted for use with other glue shoes.

Glue wheel 10 has a hub 24 with a central axis 26 about which the hub is adapted to rotate. Hub 24 has a rim 28 with a plurality of spaced structures 30 recessed in the rim and projecting outwardly. Recessed structures 30 are flanked by smooth side sections 32 for sealing engagement with the bottom of glue shoe 14 along its lateral side walls. Glue shoe 14 is connected to a glue reservoir with glue recirculating lines 34, 36. Input line 34 is used to pump cold glue into the glue shoe, while return line 36 is used to withdraw glue from the glue shoe. The constant recirculation of glue through the glue shoe prevents the glue from drying on glue wheel 10, while the addition of solvent keeps the glue from changing consistency.

Figure 4:
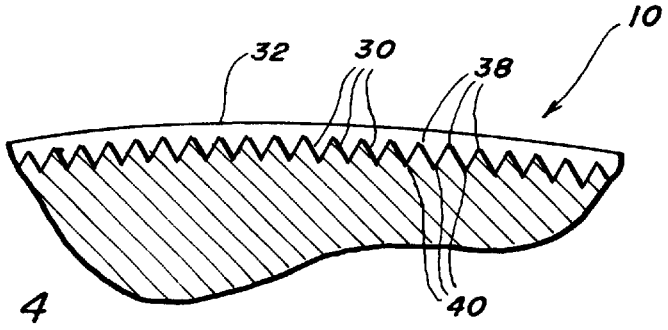
FIG. 4 is a detail taken along line 4—4 in FIG. 3.
Figure 5:
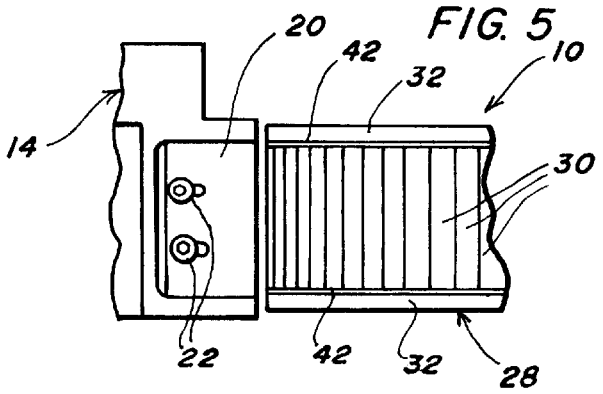
FIG. 5 is a detail taken in the direction of line 5—5 in FIG. 1.

As best seen in FIGS. 4 and 5, recessed structures 30 may be a plurality of spaced, generally transverse serrations which are preferably machined into a metal rim of hub 24. Serrations 30 crest below smooth side sections 32. In a preferred embodiment, the height of serrations from crest 38 to trough 40 is between about 0.020 and 0.025 inch and crest 38 is between about 0.002 and 0.003 inch below smooth side sections 32. It will be understood, however, that these dimensions are given by way of example and not as a limitation.

Figure 3:
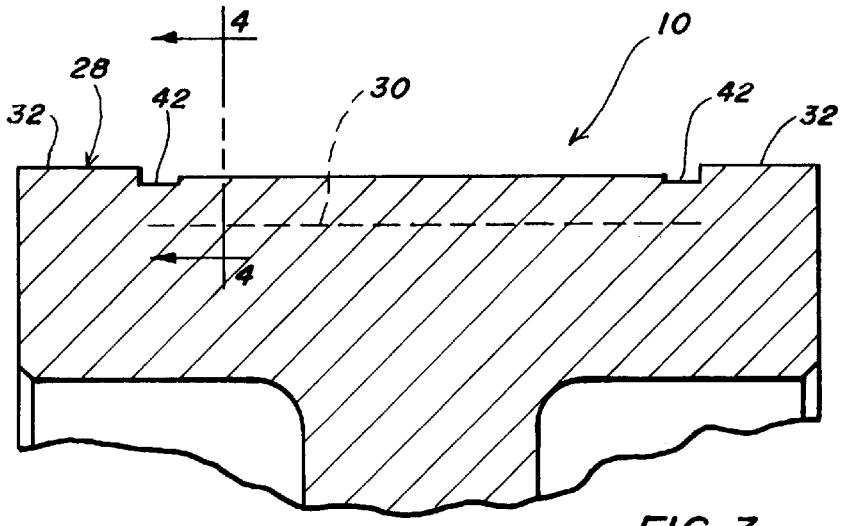
FIG. 3 is a detail, on an enlarged scale, taken along line 3—3 in FIG. 2.

As best seen in FIG. 3, a pair of opposing circumferential grooves 42 are provided in recessed structures 30 adjacent smooth side sections 32. When recessed serrations 30 are formed, crests 38 tend to fan out adjacent smooth side sections 32. Grooves 42 remove this excess material and substantially prevent the formation of a bead of dried glue on the recessed structures along the smooth side sections. In the preferred embodiment discussed above, grooves 42 are between about 0.003 and 0.005 inch deep, 0.004 inch being especially preferred, and about 0.060 inch wide.

In use, glue shoe 14 may be brought within 0.001 inch or less of smooth side sections 32 to prevent leakage of any glue. As glue wheel 10 is rotated under glue shoe 14, glue is applied by the glue shoe and metered by plate 20 between and on recessed structures 30. As the glue is metered over crests 38, it has substantially no tendency to dry and form a bead along smooth side sections 32 because the widened ends of the crests have been removed and because the grooves provide a well of wet glue which is replenished as the glue wheel rotates and the glue is recirculated through the glue shoe. When the bottom of metering plate 20 is level with the bottom of the lateral side walls of glue shoe 14, the thickness of glue pattern 16 is determined by the extent that structures 30 (e.g., serrations) are recessed. The thickness of the glue pattern will also be affected by the viscosity of the glue, pressure under which the glue is pumped into the glue shoe, speed that glue wheel 10 is rotated and other such well known factors. Because the glue pattern depends on recessed structures 30 and not on adjustments to metering plate 20, it is easier for a production worker to operate the machine. In addition, glue shoe 14 creates less drag on glue wheel 10, even when glue shoe 14 rides directly on glue wheel 10 because there is less friction between the metering plate and structures 30.

The operator may increase the thickness of the glue pattern by selecting another glue wheel 10 with more deeply recessed structures 30 or by adjusting metering plate 20 away from glue wheel 10 such that the bottom of the plate is elevated above the bottom of the lateral side walls of glue shoe 14. Typically the adjustable clearance between the bottom of metering plate and smooth side sections 32 is in the order of about 0.001 to about 0.016 inch; however, adjustability outside these limits can be provided if required.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A glue wheel for applying a glue pattern of cold glue to a receiving surface comprising:

a hub having a central axis and being adapted for rotation about said axis, said hub having a rim with a plurality of spaced structures recessed in the rim and projecting outwardly, said recessed structures cresting below and flanked by smooth side sections for sealing engagement with a glue shoe, a circumferential groove in the recessed structures immediately adjacent each of the smooth side sections, said grooves recessed relative to the recessed structures and the smooth side sections, whereby the glue is metered between and on the recessed structures by the glue shoe for application to a receiving surface in a desired glue pattern and the circumferential grooves substantially prevent the formation of a bead of dried glue along the smooth side sections.

2. The glue wheel of claim 1 wherein the recessed structures are transverse serrations with a crest and a trough, said crest being between about 0.002 and 0.003 inch below the smooth side sections and said trough being between about 0.020 and 0.025 inch below the smooth side sections.

3. The glue wheel of claim 2 wherein each circumferential groove is between about 0.003 and 0.005 inch below the smooth side sections.

4. The glue wheel of claim 3 wherein each circumferential groove is about 0.060 inch wide.

5. A glue wheel for applying a glue pattern of cold glue to a receiving surface comprising:

a hub having a central axis and being adapted for rotation about said axis, said hub having a metal rim with a plurality of spaced, transverse serrations recessed in the rim and projecting outwardly, said recessed structures flanked by smooth side sections for sealing engagement with a glue shoe, and said serrations cresting below the smooth side sections, a circumferential groove in the recessed serrations immediately adjacent each of the smooth side sections, said grooves recessed relative to the recessed structures and the smooth side sections, whereby the glue is metered between and on the recessed serrations by the glue shoe for application to a receiving surface in a desired glue pattern and the circumferential grooves substantially prevent the formation of a bead of dried glue along the smooth side sections.

* * * * *